US008998148B2

(12) United States Patent
Parida et al.

(10) Patent No.: US 8,998,148 B2
(45) Date of Patent: Apr. 7, 2015

(54) ACOUSTICAL WARNING SYSTEM

(75) Inventors: Basant K. Parida, Bellingham, MA (US); Abdullatif K. Zaouk, Jamaica Plain, MA (US); Jason Ross, Lexington, MA (US); Grant Stephen Nash, Northborough, MA (US)

(73) Assignee: Foster-Miller, Inc., Waltham, MA (US)

( * ) Notice: Subject to any disclaimer, the term of this patent is extended or adjusted under 35 U.S.C. 154(b) by 261 days.

(21) Appl. No.: 13/507,214

(22) Filed: Jun. 13, 2012

(65) Prior Publication Data

US 2012/0318932 A1 Dec. 20, 2012

Related U.S. Application Data

(60) Provisional application No. 61/520,854, filed on Jun. 15, 2011.

(51) Int. Cl.

| | |
|---|---|
| ***B61L 23/00*** | (2006.01) |
| ***B61L 25/02*** | (2006.01) |
| ***B61L 29/00*** | (2006.01) |

(52) U.S. Cl.
CPC ..... *B61L 23/00* (2013.01)

(58) Field of Classification Search
USPC ..... 246/111–115, 122 R–124, 473 R, 473.1
See application file for complete search history.

(56) References Cited

U.S. PATENT DOCUMENTS

| | | | | |
|---|---|---|---|---|
| 7,429,935 | B1 * | 9/2008 | Brenner | 340/907 |
| 2007/0102591 | A1 * | 5/2007 | Toth | 246/122 R |
| 2013/0214097 | A1 | 8/2013 | Graber | |

* cited by examiner

*Primary Examiner* — R. J. McCarry, Jr.
(74) *Attorney, Agent, or Firm* — Iandiorio Teska & Coleman, LLP

(57) ABSTRACT

A locomotive warning system includes an acoustical warning subsystem configured to emit variably directed sound. A controller subsystem is responsive to an initiation command and is configured to trigger the acoustical warning subsystem to begin a sounding sequence when the initiation command is received at a first directivity angle and to continue the sound blast sequence at increasing directivity angles for a pre-establish time and/or distance traveled.

40 Claims, 5 Drawing Sheets

ACOUSTICAL WARNING SYSTEM

RELATED APPLICATIONS

This application claims benefit of and priority to U.S. Provisional Application Ser. No. 61/520,854 filed Jun. 15, 2011 under 35 U.S.C. §§119, 120, 363, 365, and 37 C.F.R. §1.55 and §1.78 and is incorporated herein by this reference.

FIELD OF THE INVENTION

The subject invention relates primarily to train horns.

BACKGROUND OF THE INVENTION

Due to vehicle/train and person/train collisions, by federal law and or regulation, all trains must sound their horns at a track/road intersection: two long blasts, one short blast, and then another long blast. The total blast sequence is 15-25 seconds in duration depending on the speed of the train.

When some people hear that whistle blowin', they hang their head and cry. Due to the annoyance train horn sounding causes people in homes, businesses, and abutting properties or in close proximity to the track/road intersection, federal regulations also prescribe that the sounding sequence must start no sooner than one-quarter mile from the intersection and cease when the lead locomotive passes through the intersection.

Still, given that the regulations still mandate an amplitude of 96-110 A-weighted decibels (dBA) 100 feet forward of locomotive, the currently omni-directional train horn sounding sequence still causes annoyance to people in homes, business, and abutting properties or in close proximity to train/road intersections. See generally U.S. published application No. 2007/0102591 incorporated herein by this reference.

The '591 patent application proposes a narrow beam acoustic emitter located at train/road crossings, oriented parallel to the road, and triggered at a time based on the speed of the train and the time it will reach a predetermined point.

SUMMARY OF THE INVENTION

Proposed is an acoustical warning system and method, typically for train locomotives, that meets Federal law and regulations for the use of locomotive horns and yet minimizes the amount, of high decibel noise heard by people in homes, businesses, and people near an intersection while still providing sufficient notification or warning that a train is approaching the intersection.

In one preferred embodiment, the sound directivity angle is small when the train is still some distance from the intersection and then the directivity angle increases, preferably as a function of the speed of the train and location of train relative to crossing, to a maximum directivity angle as the lead locomotive passes through the intersection. For curved tracks and skewed road crossings, the acoustical warning system steers its beam so as to cover the critical positions on the road to ensure safety of motorists and pedestrians.

Featured is an acoustical warning system and method comprising an acoustical warning subsystem configured to emit a variably directed sound. A controller subsystem is responsive to an initiation command and is configured to trigger the acoustical warning subsystem to begin a sounding sequence when the initiation command is received at a first directivity angle and to then continue the sequence at increasing directivity angles for a pre-establish time and/or distance traveled.

In one preferred embodiment, a speed determination subsystem is included and the controller is further configured to calculate a directivity angle rate of change based on speed and to increase the directivity angle of the acoustical warning subsystem according to the calculated directivity angle rate of change. In but one example, the pre-established time is the time to travel one-quarter mile or approximately one-quarter of a mile. A location determination subsystem can be used to trigger the initiation command. In one example, the location determination subsystem is configured to issue an initiation command at or approximately at one-quarter of a mile from the crossing.

The typical sounding sequence includes, two long blasts followed by one short blast followed by one long blast and the acoustical warning subsystem is preferably configured to produce audible blasts of greater than 96 decibels at 100 feet. In one example, the first directivity angle is a pre-established minimum directivity angle of less than 50° and the pre-established distance traveled is one-quarter of a mile or approximately one-quarter of a mile. In one design, the acoustical warning subsystem includes at least one variable directivity acoustic source positioned on a locomotive hood and aimed forward. The acoustical warning subsystem may include a plurality of acoustic beam emitters each having different directivity angles. One or more of the beam emitters can be pivotally mounted for beam steering.

An acoustical warning method in accordance with the invention features generating an initiation command triggering an acoustical warning subsystem configured to emit variably directed sound to begin a sounding sequence in response to the initiation command at a pre-established minimum directivity angle, then increasing in the directivity angle and continuing the sequence at increasing directivity angles for a pre-established time and/or distance travelled.

An acoustical warning method, in one example, includes generating an initiation command at a prescribed distance from an intersection. A directivity angle rate of change is calculated based on the speed detected. An acoustical warning subsystem configured to emit variably directed sound is triggered to begin a sounding sequence in response to the initiation command at a first directivity angle. The directivity angle is increased based on the calculated directivity angle rate of change and the sound blast sequence is continued at increasing directivity angles according to the calculated directivity angle rate of change for a pre-established time and/or distance traveled.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
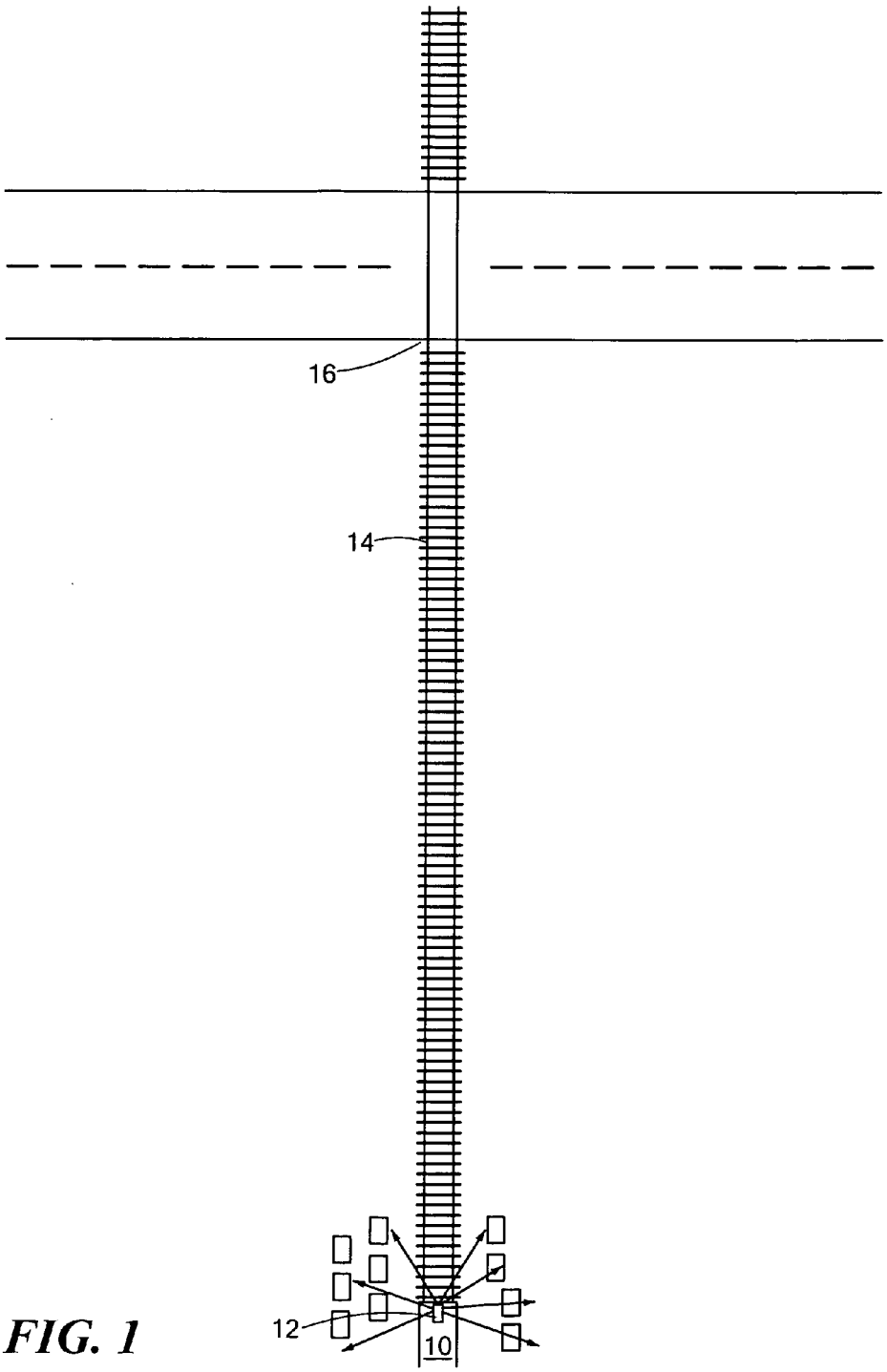
FIG. 1 is a schematic top view of a train locomotive with an omni directional horn approaching a track/road intersection.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 shows train locomotive 10 with a prior art omni-directional horn on track 14 approaching track/road intersection 16 but still some distance from the intersection. Since horn 12 is omni-directional, businesses, homes, and the like one-quarter mile or more from the intersection may hear the sounding sequence required by Federal law especially given that the amplitude is between 96 and 110 dBA 100 feet forward of the locomotive. By Federal law and/or regulation, the train crew sounds the horn at one-quarter mile from the intersection using a sequence of two long blasts, one short blast and then one more long blast for a total sequence typically of 15-25 seconds in duration depending on train speed.

Figure 2:
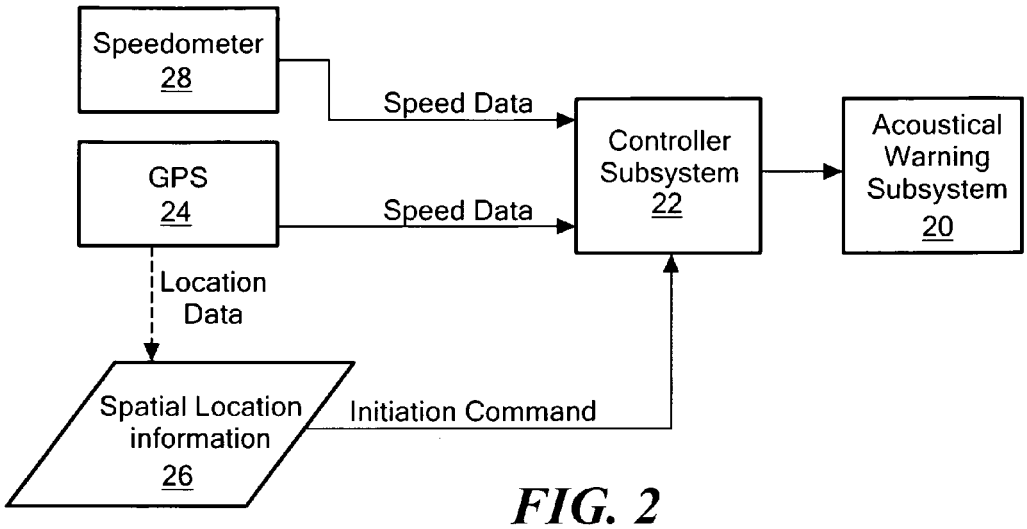
FIG. 2 is a block diagram showing the primary components associated with an example of one preferred acoustical warning system in accordance with the invention.

In one preferred example of the invention, the system includes acoustical warning subsystem 20, FIG. 2 including one or more horns configured to emit variably directed sound as an audible warning. Controller subsystem 22, which may include a microcomputer, a microcontroller, or other electronic circuitry including a microprocessor, is appropriately programmed or otherwise configured in response to an initiation command as shown at 24 to trigger acoustical warning subsystem 20 to begin a sounding sequence when the initiation command is received such that the acoustical warning subsystem begins its sequence at a pre-established minimum directivity angle less than 50° such as 42° (+/−21°).

The initiation command may be based on location data from GPS subsystem 24 which provides location data to initiate the command based on spatial location information as shown at 26. Alternatively, at approximately one-quarter mile from a track/road intersection an engineer may manually initiate the command which is intercepted by controller subsystem 22. In other embodiments, various technologies can be used to determine when the train locomotive is one-quarter mile or some other pre-established distance from the track/road intersection in order to provide spatial location information which triggers the initiation command. Examples include RFID sensors and readers, and the like. The first directivity angle used in the sequence could be fixed as in the example above or could be a function of train location, distance from a crossing, and/or speed.

Controller subsystem 22 continues the sounding sequence but now at increasing directivity angles for a pre-established time and/or distance traveled. In one preferred example, a locomotive speedometer as shown at 28 and/or GPS subsystem 24 provides locomotive speed data to controller subsystem 22 and, from the speed determination, controller subsystem 22 calculates a directivity angle rate of change based on the speed reported to steadily increase the directivity angle of the acoustical warning subsystem according to the calculated directivity angle rate of change.

Figure 3:
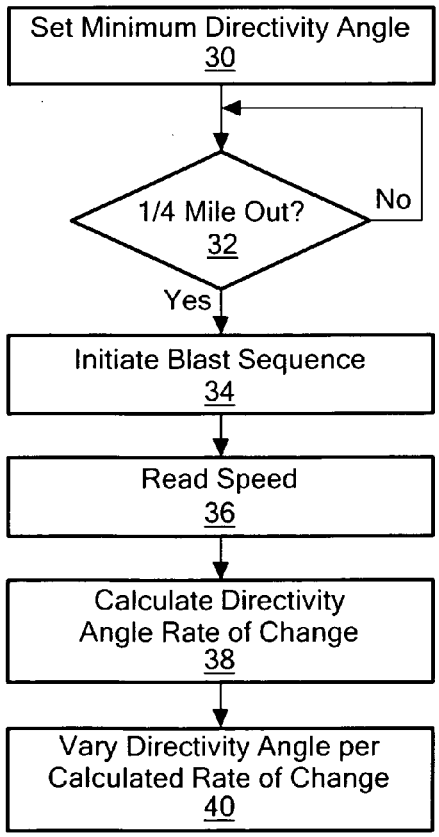
FIG. 3 is a flow chart depicting the primary steps associated with the programming of the controller subsystem shown in FIG. 2.

Thus, as shown in FIG. 3, controller subsystem 22 may be programmed to set minimum directivity angle for the acoustical warning subsystem (for example 42° as noted above) for the initial/beginning sounding sequence when the train locomotive is approximately one-quarter mile from the track/road intersection, step 30. When the one-quarter mile limit is reached, step 32, the sounding sequence is initiated, step 34. The locomotive speed is then read, step 36 and the directivity angle rate of change is calculated at step 38 based on the speed. In alternative embodiments, the directivity angle rate of change could be fixed based on typical locomotive speeds. In the example shown, however, at step 40 the directivity angle is varied for acoustical warning subsystem 20, FIG. 2 based on the calculated directivity angle rate of change determined by controller subsystem 22 so that as the locomotive nears or begins to pass through the track/road intersection the directivity angle of the acoustical warning subsystem reaches a maximum such as 198° (+/−99°). In one example, the directivity angle rate of change varies from approximately 4 degrees per second to 31 degrees per second for a locomotive travelling at approximately 60 mph.

Figure 4:
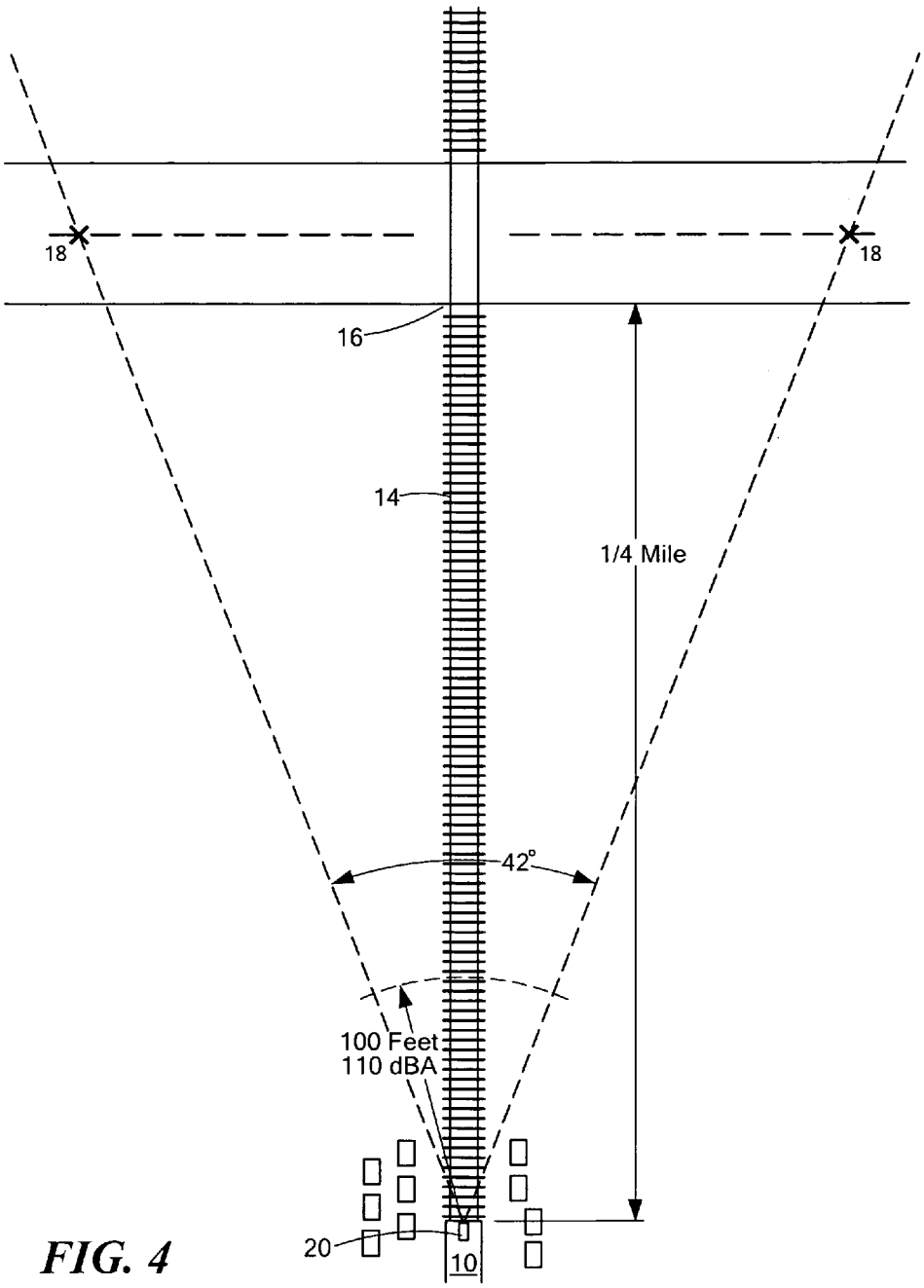
FIG. 4 is a schematic top view of a train equipped with an example of an acoustical warning system in accordance with the system of FIG. 2 approximately one-quarter mile from a track/road intersection where the directivity angle of the train horn(s) is at a predetermined minimum.
Figure 5:
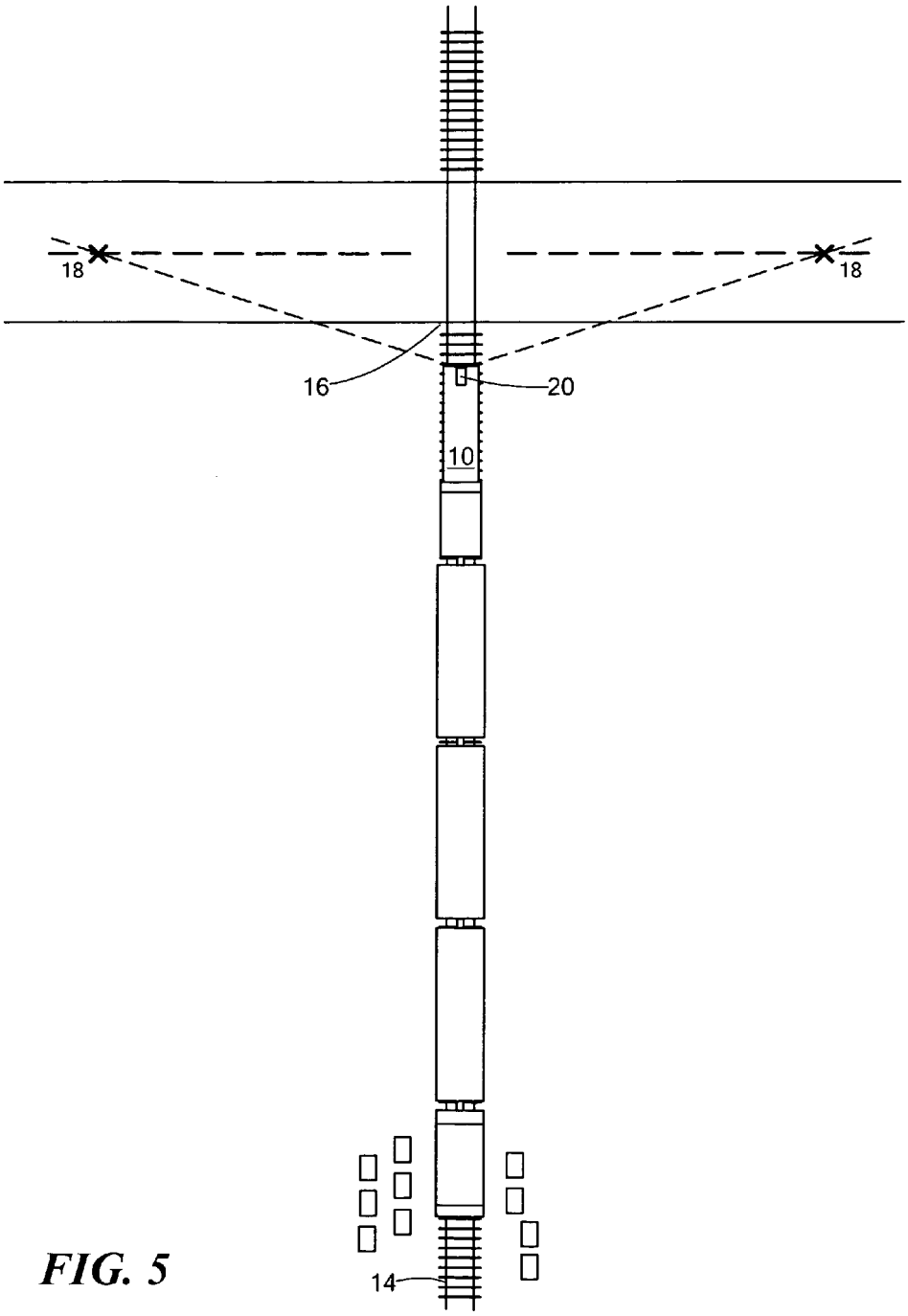
FIG. 5 is a schematic depiction of the train locomotive of FIG. 4 now close to the track/road intersection where the horn(s) directivity angle is approaching its maximum.

Thus, the directivity angle of the variably directed sound emitted by the acoustical warning system is at a minimum as shown in FIG. 4 one-quarter mile from the track/road intersection 16 and the surrounding homes, businesses, and people are not as annoyed by the 96-110 dBA sound blast. In FIG. 4 the directivity angle 42° shown for a tangent track covers the critical positions 18 on the road on either side of the track. The critical position on the road is defined as a location about 500 feet from the intersection, where a motorist traveling at 50 mph may be acoustically warned of an approaching train/locomotive so as to safely stop before reaching the intersection. Then, as the train continues toward the track/road intersection, the directivity angle of the train acoustical warning system increases, preferably based on the speed of the train, so as to cover the critical positions 18 at all time as shown in FIG. 5. As the locomotive passes through intersection 16, the maximum directivity angle is typically 198°. Note that in FIG. 4, cars and/or people on the road approaching the intersection within the critical distance from the intersection still clearly hear the audible signal.

Figure 6A:
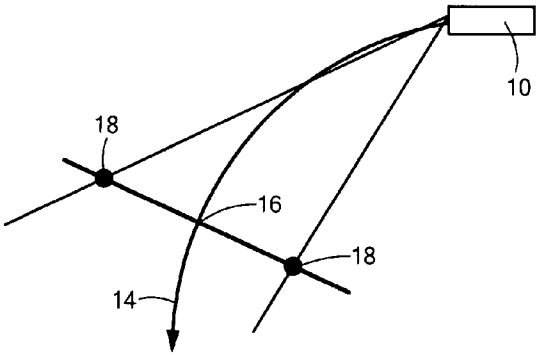
FIG. 6 is a schematic depiction of acoustic beam steering at a road crossing for a curved railway track and at a skewed road crossing.
Figure 6B:
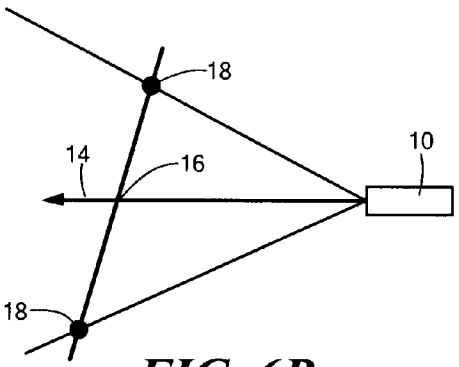

Studies were conducted to determine the appropriate directivity angle based on vehicle speeds of 20, 30, 40, and 50 miles per hour. Assuming a variably directed horn is mounted in the center of a long locomotive hood approximately 30 feet back from the front of the locomotive, aimed forward, and the narrowest angle that is preferably maintained at one-quarter mile from the crossing is 14° (+/−7 degrees) for cars traveling at 20 miles per hour, and 210° at the crossing. Still, to protect motorists driving at 50 miles per hour on crossing roads, the directivity angle required to alert motorists located at critical position 18, FIG. 4 in time to stop their vehicles before crossing is as narrow as 42° when the train is one-quarter mile from the crossing, and much wider when the first locomotive approaches the crossing and the beam covers the critical positions 18, FIG. 5. In order to protect motorists driving at 50 mph on roads crossing a curved railway track or a skewed road crossing a tangent track, the acoustical warning system will provide main sound beam widening and also steering capability so as to cover critical positions 18, FIG. 6 on the cross road.

The main beam of sound generated by the acoustical warning system is assumed to be a constant throughout the required angle and then drops off at a rate of two-thirds of a dBA per degree meaning the signal would be 10 dBA down 15° beyond the extent of the main beam and 20 dBA down 30° beyond the extent of the main beam. The maximum reduction of the optimized horn at angles beyond the main beam including the radiation rear of the horn is assumed to be 25 dBA on an overall A-weighted basis. Vertical directivity should be sufficient to provide adequate signal to those close to the locomotive and to handle elevation changes of the surrounding terrain. Therefore, the vertical directivity optimized horn should be similar to the horizontal directivity to provide adequate coverage.

The acoustical warning system may be configured with one or more acoustic sources. With multiple acoustic sources, the desired sound directivity patterns of varying angles and steering may be controlled through the geometrical configuration of the sources, the amplitudes of sound generated by each source, and the phase and timing of the sound generation.

Figure 7:
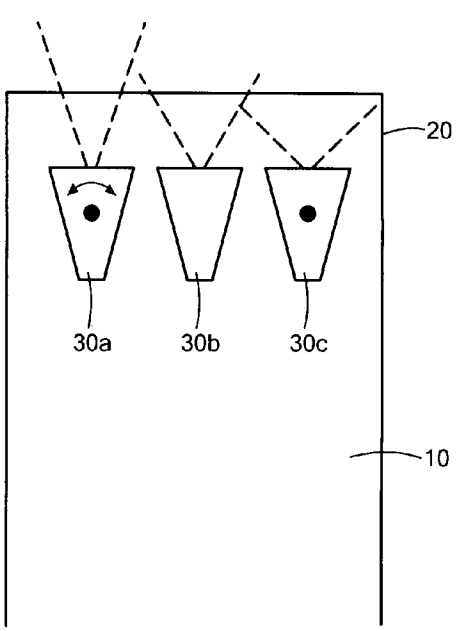
FIG. 7 schematically depicts typical acoustical warning system comprising of one or more acoustic source capable of varying sound directivity angle as well as sound beam steering.

FIG. 7 shows locomotive 10 with acoustic warning subsystem 20 comprising three acoustic beam emitters 30*a*, 30*b*, and 30*c* each configured with a different directivity angle. In one example, emitter 30*a* may produce a beam of sound with a 42° directivity angle, emitter 30*b* may produce a beam of sound with a 120° directivity angle, and emitter 30*c* may produce a beam of sound with a 198° directivity angle. At one-quarter mile from an intersection, emitter 30*a* is energized (for example to sound two long blasts), then emitter 30B is energized (for example to sound one short blast), and finally emitter 30*c* is energized (to sound one long blast). Additional emitters can be provided.

All the emitters or, for example, emitters 30*a* and 30*c* may be pivotally mounted to steer the sound beams as desired. GPS data can be used to determine skewed road crossing or curved tracks and to determine if beam steering is required.

In other embodiments, varying beam directivity angles and/or beam steering is accomplished in one or more beam emitters by selectively energizing its active components or transducers to change the directionality of the beam. Beam steering can be accomplished the same way or by physically rotating the beam emitter.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A warning system comprising:

an acoustical warning subsystem configured to emit variably directed sound; and a controller subsystem responsive to an initiation command and configured to:

trigger the acoustical warning subsystem to begin a sounding sequence when the initiation command is received at a first directivity angle, and continue the sounding sequence at increasing directivity angles for a pre-establish time and/or distance traveled.

2. The system of claim 1 further including a speed determination subsystem and the controller is further configured to calculate a directivity angle rate of change based on train speed and to increase the directivity angle of the acoustical warning subsystem according to the calculated directivity angle rate of change.

3. The system of claim 2 in which the pre-established time is the time to travel one-quarter mile or less and to limit sounding to less than 25 seconds.

4. The system of claim 1 further including a location determination subsystem triggering the initiation command.

5. The system of claim 4 in which the location determination subsystem is configured to issue an initiation command at or approximately at one-quarter of a mile from the crossing.

6. The system of claim 1 in which the sounding sequence includes, at least, two long blasts followed by one short blast followed by one long blast.

7. The system of claim 1 in which the acoustical warning subsystem is configured to produce sound blasts of greater than 96 decibels at 100 feet forward.

8. The system of claim 1 in which the first directivity angle is a pre-established minimum directivity angle of less than 50° .

9. The system of claim 1 in which the pre-established distance traveled is one-quarter of a mile or approximately one-quarter of a mile.

10. The system of claim 1 in which the acoustical warning subsystem includes a plurality of acoustic beam emitters having different directivity angles.

11. The warning system of claim 10 in which one or more said beam emitters are steerable.

12. A warning subsystem comprising:

an acoustical warning subsystem configured to emit a variably directed sound;

a speed determination subsystem for determining speed; and a controller subsystem responsive to an initiation command and the speed determination subsystem and configured to:

trigger the acoustical warning subsystem to begin a sounding sequence when the initiation command is received at a first directivity angle, calculate a directivity angle rate of change based on speed, and continue the sequence at increasing directivity angles based on the calculated directivity rate of change for a pre-established time and/or distance traveled.

13. The system of claim 12 in which the pre-established time is the time to travel one-quarter mile or less and to limit soundings to less than 25 seconds.

14. The system of claim 12 further including a location determination subsystem triggering the initiation command.

15. The system of claim 14 in which the location determination subsystem is configured to issue an initiation command at or approximately at one-quarter of a mile from the crossing.

16. The system of claim 12 which the sounding sequence includes, at least, two long blasts followed by one short blast followed by one long blast.

17. The system of claim 12 in which the acoustical warning subsystem is configured to produce sound blasts of greater than 96 decibels at 100 feet forward of the locomotive.

18. The system of claim 12 in which the first directivity angle is a pre-established minimum directivity angle of less than 50° .

19. The system of claim 12 in which the pre-established distance traveled is one-quarter of a mile or less and to limit soundings to less than 25 seconds.

20. The system of claim 12 in which the acoustical warning subsystem includes a plurality of acoustic beam emitters having different directivity angles.

21. . The system of claim 20 in which one or more said beam emitters are pivotally mounted for beam steering.

22. A warning method comprising:

generating an initiation command;

triggering an acoustical warning subsystem configured to emit variably directed sound to begin a sounding sequence in response to the initiation command at a first directivity angle;

increasing in the directivity angle; and continuing the sequence at increasing directivity angles for a pre-established time and/or distance travelled.

23. The method of claim 22 in which the initiation command is generated at a prescribed distance from an intersection.

24. The method of claim 22 in which the initiation command is triggered manually.

25. The method of claim 22 in which the initiation command is triggered by one or more position sensors.

26. The method of claim 22 further including detecting speed.

27. The method of claim 26 in which increasing the directivity angle includes calculating a directivity angle rate of change based on the detected speed.

28. The method of claim 22 in which the pre-established time is the time to travel one-quarter mile or approximately one-quarter of a mile.

29. The method of claim 22 further including determining location to trigger the initiation command.

30. The method of claim 29 in which a location determination subsystem is configured to issue an initiation command at or approximately at one-quarter of a mile from the crossing.

31. The method of claim 22 which the sounding sequence includes, at least, two long blasts followed by one short blast followed by one long blast.

32. The method of claim 22 in which the acoustical warning subsystem is configured to produce sound blasts of greater than 96 decibels at 100 feet.

33. The method of claim 22 in which the first directivity angle is a pre-established minimum directivity angle of less than 50° .

34. The method of claim 22 in which the pre-established distance traveled is one-quarter of a mile or less and to limit the sounding to less than 25 seconds.

35. The method of claim 22 in which the acoustical warning subsystem includes at least one variable directivity acoustic source positioned on a locomotive and aimed forward.

36. The method of claim 22 in which the acoustical warning subsystem includes a plurality of acoustic beam emitters having different directivity angles.

37. The method system of claim 36 in which one or more said beam emitters are steerable.

38. A warning method comprising:

generating an initiation command at a prescribed location;

triggering an acoustical warning subsystem configured to emit variably directed sound to begin a sounding sequence in response to the initiation command at a first directivity angle;

increasing the directivity angle; and continuing the sequence at increasing directivity angles for a pre-established time and/or distance traveled.

39. A warning method comprising:

detecting speed;

calculating a directivity angle rate of change based on a detected speed;

generating an initiation command;

triggering an acoustical warning subsystem configured to emit variably directed sound to begin a sounding sequence in response to the generated initiation command at a first directivity angle;

increasing the directivity angle based on the calculated directivity angle rate of change; and continuing the sound sequence at increasing directivity angles for a pre-established time and/or distance traveled.

40. A warning method comprising:

generating an initiation command at a prescribed distance from an intersection;

detecting speed;

calculating a directivity angle rate of change based on the detected speed;

triggering an acoustical warning subsystem configured to emit variably directed sound to begin a sounding sequence in response to the initiation command at a first directivity angle;

increasing the directivity angle based on the calculated directivity angle rate of change; and continuing the sound sequence at increasing directivity angles according to the calculated directivity angle rate of change.

* * * * *